US006802675B2

(12) United States Patent
Timmons et al.

(10) Patent No.: US 6,802,675 B2
(45) Date of Patent: Oct. 12, 2004

(54) TWO STAGE WALL CONNECTOR

(75) Inventors: Michael Timmons, Warrenton, VA (US); Roger Bloomfield, Great Falls, VA (US)

(73) Assignee: Reinforced Earth Company, VA (US)

( * ) Notice: Subject to any disclaimer, the term of this patent is extended or adjusted under 35 U.S.C. 154(b) by 0 days.

(21) Appl. No.: 10/159,686

(22) Filed: May 31, 2002

(65) Prior Publication Data

US 2003/0223825 A1 Dec. 4, 2003

(51) Int. Cl.[7] ..... E02D 3/02

(52) U.S. Cl. ..... 405/284; 405/262; 405/286; 403/43

(58) Field of Search ..... 705/262, 284, 705/285, 286, 287; 52/231, 234, 232, 506.6; 403/43, 44, 48

(56) References Cited

U.S. PATENT DOCUMENTS

| | | | | |
|---|---|---|---|---|
| 1,879,636 A | * | 9/1932 | Cole | 403/48 |
| 3,421,326 A | | 1/1969 | Vidal | |
| 3,686,873 A | | 8/1972 | Vidal | |
| 3,743,330 A | * | 7/1973 | Itatani | 403/44 |
| 4,045,965 A | | 9/1977 | Vidal | |
| 4,116,010 A | | 9/1978 | Vidal | |
| 4,961,673 A | | 10/1990 | Pagano et al. | |
| 5,531,547 A | * | 7/1996 | Shimada | 405/262 |
| 5,669,737 A | * | 9/1997 | Equilbec et al. | 405/284 |
| 5,749,680 A | * | 5/1998 | Hilfiker et al. | 405/286 |
| 5,797,706 A | * | 8/1998 | Segrestin et al. | 405/284 |
| 5,971,669 A | | 10/1999 | Crigler | |

FOREIGN PATENT DOCUMENTS

| | | | | |
|---|---|---|---|---|
| JP | 60138119 | * | 7/1985 | 405/262 |

* cited by examiner

*Primary Examiner*—Jong-Suk Lee
(74) *Attorney, Agent, or Firm*—Banner & Witcoff, Ltd.

(57) ABSTRACT

Mechanically stabilized retaining wall structures are comprised of a stabilized earth mass connected to a precast concrete panel facing wall. A lengthwise adjustable turnbuckle style connector assembly accommodates horizontal and vertical offsets in the connection points. An array of the connection assemblies comprise a three-dimensional space truss that accomodates wall movement horizontally and vertically with respect to the wall face as well as perpendicular to the wall.

15 Claims, 6 Drawing Sheets

FIG.1
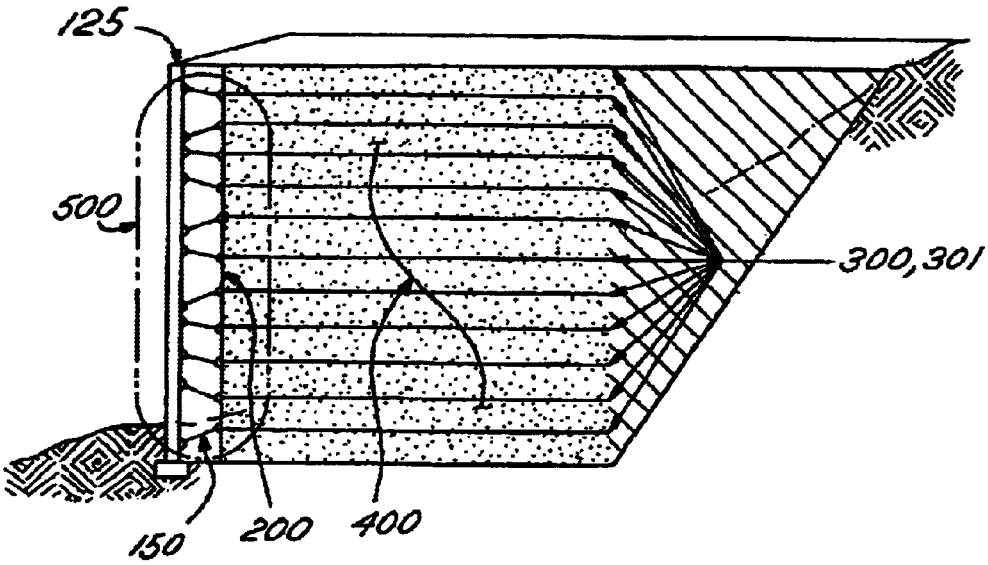
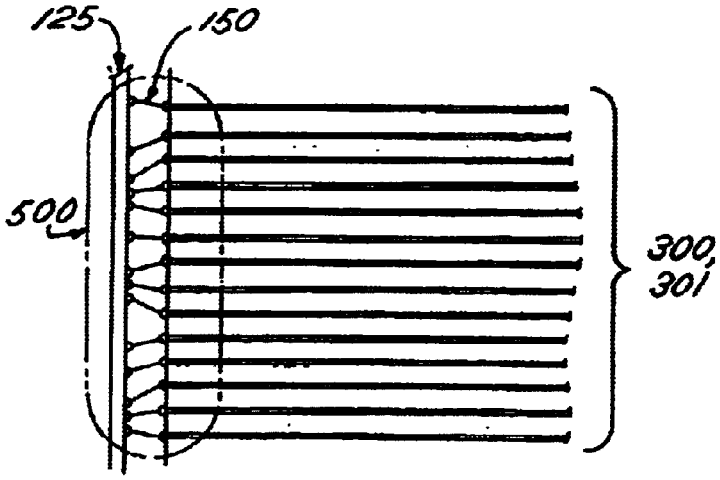
FIG.2

TWO STAGE WALL CONNECTOR

FIELD OF THE INVENTION

This invention relates generally to stabilized earthen structures, and specifically relates to an adjustable turnbuckle style assembly for connecting precast concrete panels to a previously constructed wire face wall, which has been or may be subjected to foundation settlement.

BACKGROUND OF THE INVENTION

Retaining wall structures may be comprised of backfill or earth material with a facing of precast panels. Mechanically stabilized earth structures are generally described in a series of Vidal patents including U.S. Pat. Nos. 3,421,326, 3,686,873, 4,045,965, and 4,116,010.

Vidal disclosed that longitudinal, tensile members positioned within a granular, compacted mass of earth to thereby enhance the coherency of the particles that form the mass. The stabilized soil mass can then serve as a wall or embankment. This phenomenon of enhanced coherency is accomplished, at least in part, by frictional engagement of particles in the mass with the tensile members or tie strips extending through the mass. Often such stabilized earthen mass includes a facing made from precast concrete panels.

A variety of methods and apparatus are known for attaching the tensile members projecting from the stabilized earthen mass to the precast concrete panels. For example, U.S. Pat. No. 4,961,673, issued to Pagano, discloses a connector that attaches a mounting plate, extending from the back face of a panel to a tie strip extending from within the stabilized soil mass. The attachment is achieved by threading a bolt through the opening in both the tie strip and the mounting plate and securing the bolt with a nut. The Pagano arrangement permits little adjustability with regard to horizontal and vertical offsets of the panel connectors vis-à-vis the tiestrips when installed.

U.S. Pat. No. 5,971,669, issued to Crigler, discloses a connector that permits some horizontal and vertical adjustments at the attachment points of the precast concrete panels and the tensile strips of the mechanically stabilized earth structure. The Crigler connection has a two-part housing, i.e., there are two, separate female connectors that threadably receive the male turnbuckle through the open end of the housing. The connection attaches the wire mesh panels that define a face for the stabilized soil mass, to precast concrete facing panels. The attachment at the panel facing is made by means of an elongate member oriented substantially parallel to the ground level that passes through the aperture at the end of the first housing as well as apertures that extend from the face of the precast concrete panels. The apertures are lined up, and the elongate member is passed through the series of apertures to secure the connector. The connection at the precast concrete panel wall, however, allows movement in the longitudinal direction of the member between the apertures.

When constructing an earth retaining wall of the type described, the granular material, which is compacted for cooperation with the tensile members, may not fully consolidate to its final volume during the period of wall construction. For example, compacted earth may only consolidate approximately 90% of its expected bulk consolidation during the construction phase of such a retaining wall. Over time, the bulk form may therefore continue to consolidate and, as a result, differential settlement may occur between the soil mass and the precast panel facing.

Due not only to the difficulties inherent in predicting differential settlement, but also to general variations in construction tolerances, the connecting points between the precast concrete panels and a previously constructed wire face wall may not line up in directly opposing positions. In this event, some vertical and horizontal offset between the connecting points may necessarily result.

SUMMARY OF THE INVENTION

The present invention is a low-cost connector assembly that efficiently allows for significant differential settlement between precast concrete facing panels and the mechanically stabilized earth mass without transferring undue stress to the wall panels. The invention is an adjustable assembly that connects fixed points on the face of the precast concrete panels to the wire mesh wall that can accommodate significant offsets between connection points. The universal joint connections allow the connector assemblies to be rotated such that the connection points in the closest proximity can be linked. The invention provides a plurality of connectors where the ends are pivotally connected at fixed spaced pivot points to accommodate misalignment by forming angled rather than straight connections, which in combination defines a three-dimensional truss. The ends of each connector define a first array at the facing panels and a second array at the connection of the connector to the stabilized earth structure such as to a wire mesh facing. These and other objectives, advantages, and features of the invention will be set forth in the detailed description which follows.

BRIEF DESCRIPTION OF THE DRAWING

In the detailed description which follows, reference will be made to the drawing comprised of the following figures:

FIG. 1 is an elevation view of a mechanically stabilized earth mass connected to a panel wall by multiple connection assemblies.

FIG. 2 is a plan view of FIG. 1.

DETAILED DESCRIPTION OF THE INVENTION

Figure 3:
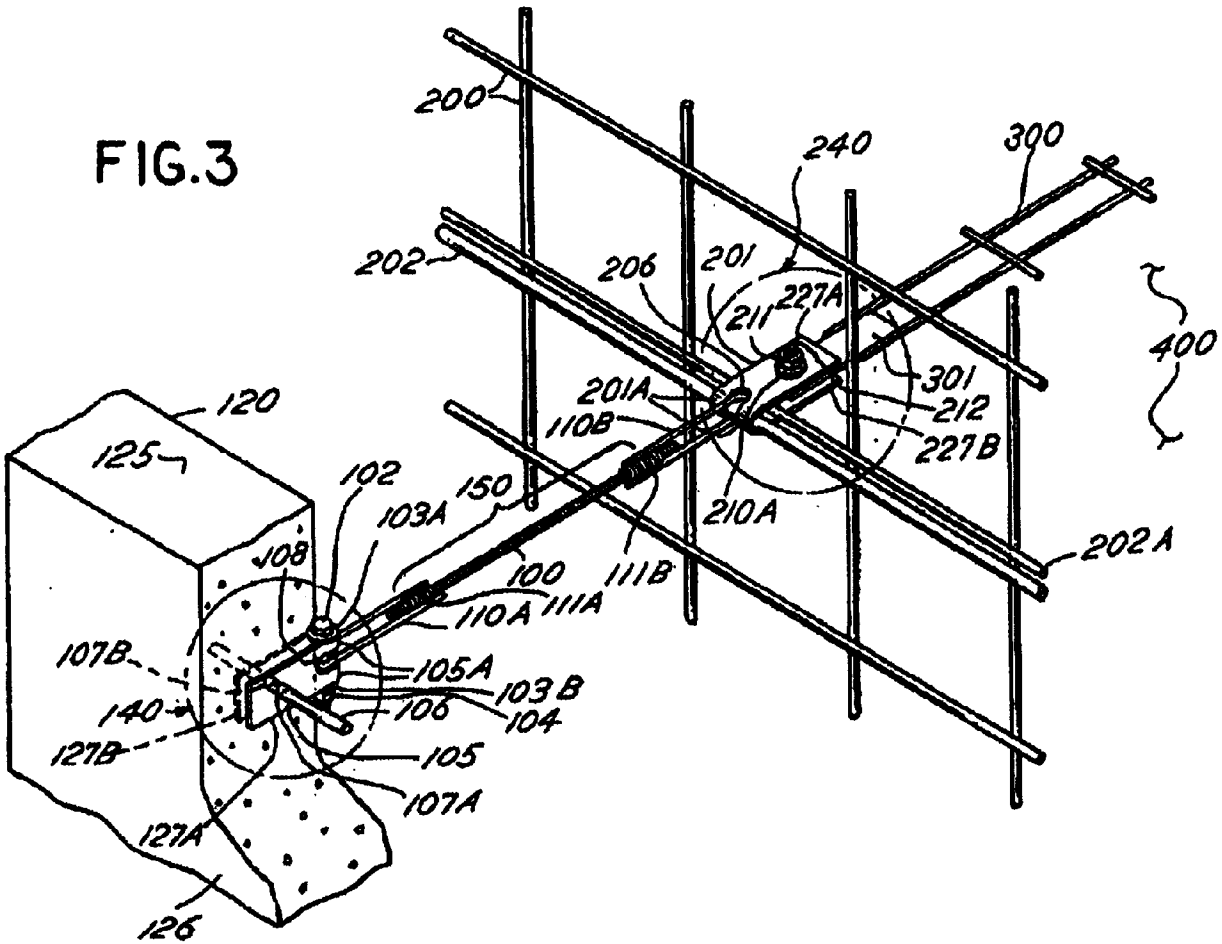
FIG. 3 is a perspective view of the completed connector assembly incorporating the present invention with ladder-type tensile members used in the mechanically stabilized earth mass.

The connector assembly of the present invention can be illustrated by describing the method of installation of the connector with reference to the drawing FIGS. 1, 2, 3, 4, 5, 6, 7, 8, 9, and 10. Like numbers thus designate like parts in the respective drawings.

FIGS. 1 and 2 illustrate a completed mechanically stabilized earth mass 400. The wire facing units 200 form the face of the mechanically stabilized earth mass 400. Tensile reinforcement 300, 301 is connected to the wire facing units 200 and passes through the earth mass. A panel wall 125 is connected to the wire facing units 200 by a plurality of connector assemblies 150. An array of connector assemblies 150 at various angled directions define in combination a three dimensional space truss 500 that resists wall movement horizontally, vertically, as well as inward or outward from the face of the mechanically stabilized earth mass.

FIG. 3 illustrates the configuration and appearance of a connector assembly 150 in relation to a panel wall 125 and the wire facing units 200 of a mechanically stabilized earth mass 400. The panel wall 125 is preferably comprised of multiple precast concrete forms or panels 126.

Figure 10:
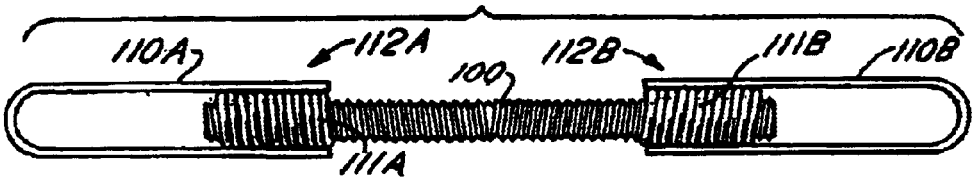
FIG. 10 is an elevation view of the connector assembly.

The connector assembly, also referred to as a turnbuckle assembly, 150 is comprised of a threaded rod 100 that is threadably received by coil nuts 111A, 111B at each end which are connected respectively to coil loops 110A, 110B. The coil nuts 111A, 111B are typically connected to the coil loops 110A, 110B offsite and prior to construction by welding. The connector assembly 150 is also shown in FIG. 10. The coil loops, or longitudinal loops, 111A, 111B and coil nuts, or threaded sockets, 110A, 110B form connection adjustment mechanisms, also referred to as turnbuckle brackets, 112A, 112B that permit the connector assembly 150 to be lengthwise adjustable by turning the threaded rod 100 (or loops 110A, 110B) in a turnbuckle fashion thus simultaneously retracting or extending coil loops 110A, 110B from the midpoint between the loops 110A, 110B.

The first coil loop 110A is attached to the precast concrete panel 125 at a generally fixed connection point. The precast concrete panel 125 has a slotted clip, or linkage, 105 protruding from the back face 120 of the wall 125. The slotted clip 105 is also referred to as a linkage. The slotted clip 105 is a curved member with the crown 105A protruding from the back face 120 of the wall panel 125, and the legs 127A, 127B extending into the wall panel 125. The slotted clip 105 has apertures 107A, 107B in the legs 127A, 127B of the slotted clip 105 that receive an anchor rod 106. The anchor rod 106 distributes the tensile stress exerted by the connector assembly and prevents a pull-out type failure. The anchor rod 106 is inserted into the apertures 107A, 107B of the slotted clip 105 and cast-in-place within the precast concrete panel 125 such that it is an integral part of the panel 125.

The crown 105A of the slotted clip 105 has a notch 108 cut out at the midpoint to receive the coil loop 110A of the connector assembly 150 at this connection point. The notch 108 is of sufficient size to allow the connector assembly 150 to be pivotally rotated from side to side about the longitudinal axis of a bolt 102. As the slotted clip 105 is cast in concrete, the pivot points are generally fixed at spaced intervals. Thus, after inserting the coil loop 110A into the notch 108 cut out of the slotted clip 105, and aligning the aperture of the coil loop 110A with the apertures created by the crown 105A of the slotted clip 105 that extend beyond the back face of the panel 125, a pin, typically a bolt, 102 is inserted vertically through the aperture 110A and the apertures created by the crown 105A to affix the connection. The bolt 102 is secured with a nut 104 and washers 103A, 103B on each end to prevent the bolt 102 from passing through the apertures created by the crown 105A of the slotted clip 105. When the pin 102 is secured, a univeral joint mechanism 140 is formed that allows the connector assembly 150 to pivotally move with respect to the panel wall 125.

Figure 7:
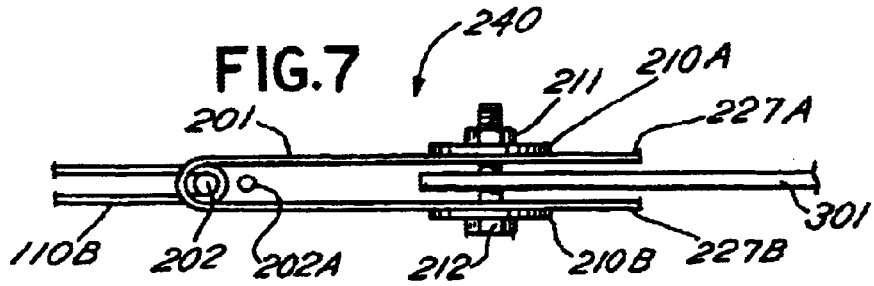
FIG. 7 is an elevation view of the connection to the mechanically stabilized earth mass.
Figure 8:
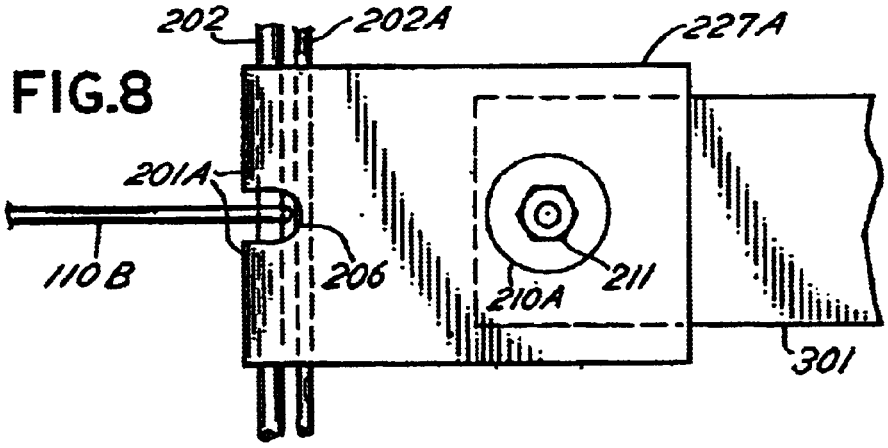
FIG. 8 is a plan view of FIG. 7.
Figure 9:
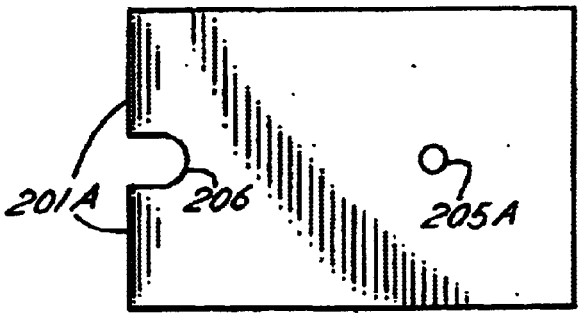
FIG. 9 is a plan view of the slotted clip used in the connection to the mechanically stabilized earth mass.

The second coil loop 110B is attached to the wire facing or mesh 200 of the mechanically stabilized earth mass 400, also called the retained backfill. A second slotted clip, or linkage, 201 is connected to the wire facing 200 where a ladder-type tensile member 300 extends rearward into retained backfill. The slotted clip 201 is curved with apertures 205A, 205B in the legs 227A, 227B of slotted clip 201. FIG. 9 shows the aperture 205A in greater detail. The slotted clip 201 is connected to the ladder member 300 by means of a bolt connection. The end of the ladder member 300 has a connector section or plate 301, a flat tab section with an aperture in the center. The connector section or plate 301 is typically connected to the ladder member 300 offsite and prior to construction by means of welding. The slotted clip 201 is placed over a rod member 202A of the wire facing unit 200 such that the rod member is within the throat of the slotted clip 201. The apertures 205A, 205B of the slotted clip 201 are aligned with the aperture 301A of the connector section 301 such that a pin, typically a bolt, 212 can be passed through the apertures 205A, 205B, 301A to affix clip 201 to plate 301. The bolt 212 is secured with nut 211 and washers 210A, 210B positioned on the outside of the slotted clip 201. When the pin 212 is secured, a universal joint mechanism 240 is formed that allows the connector assembly to pivotally move with respect to the wire mesh facing 200. FIGS. 7, 8, and 9 show the universal joint mechanism in detail.

The crown 201A of the slotted clip 201 has a notch 206 cut out at the midpoint to receive the coil loop 110B of the connector assembly 150. The notch 206 is of sufficient size to allow the connector assembly 150 to be pivotally rotated. After inserting the coil loop 110B into the notch 206 cut out of the slotted clip 201, and aligning the aperture of the coil loop 110B with the apertures created by the crown 201A of the slotted clip 201, a connector rod 202 is inserted horizontally through the apertures created by the crown of the slotted clip 201 to affix the connection. The connection of the connector assembly 150 to the connection adjustment mechanisms 112A, 112B forms an adjustable connector construction. A slotted clip 201 and coil loop 110B assembly is typically provided at the end of each ladder member 300 prior to construction of the precast panel wall 125 so that the threaded rod 100 of the connector assembly 150 can be rotated to locate the nearest coil loop 110B after the connector assembly 150 has been attached to the back face 120 of the panel 125.

Either end of the connector assembly 150 can be connected first, and then rotated freely to find the nearest connection point for the opposite end of the assembly 150. For example, the connector assembly 150 can be initially attached to the wire facing unit 200 and then freely rotated to locate the nearest slotted clip 105 embedded in a precast concrete panel 125. Alternatively, the connector assembly 150 can be initially attached to a slotted clip 105 embedded in the concrete panel 125 and then rotated to locate the nearest coil loop 110B for making the connection. Threading the rod 100 into the coil nut 111B completes the connection and fixes the panel 125 from inward or outward movement.

Figure 4:
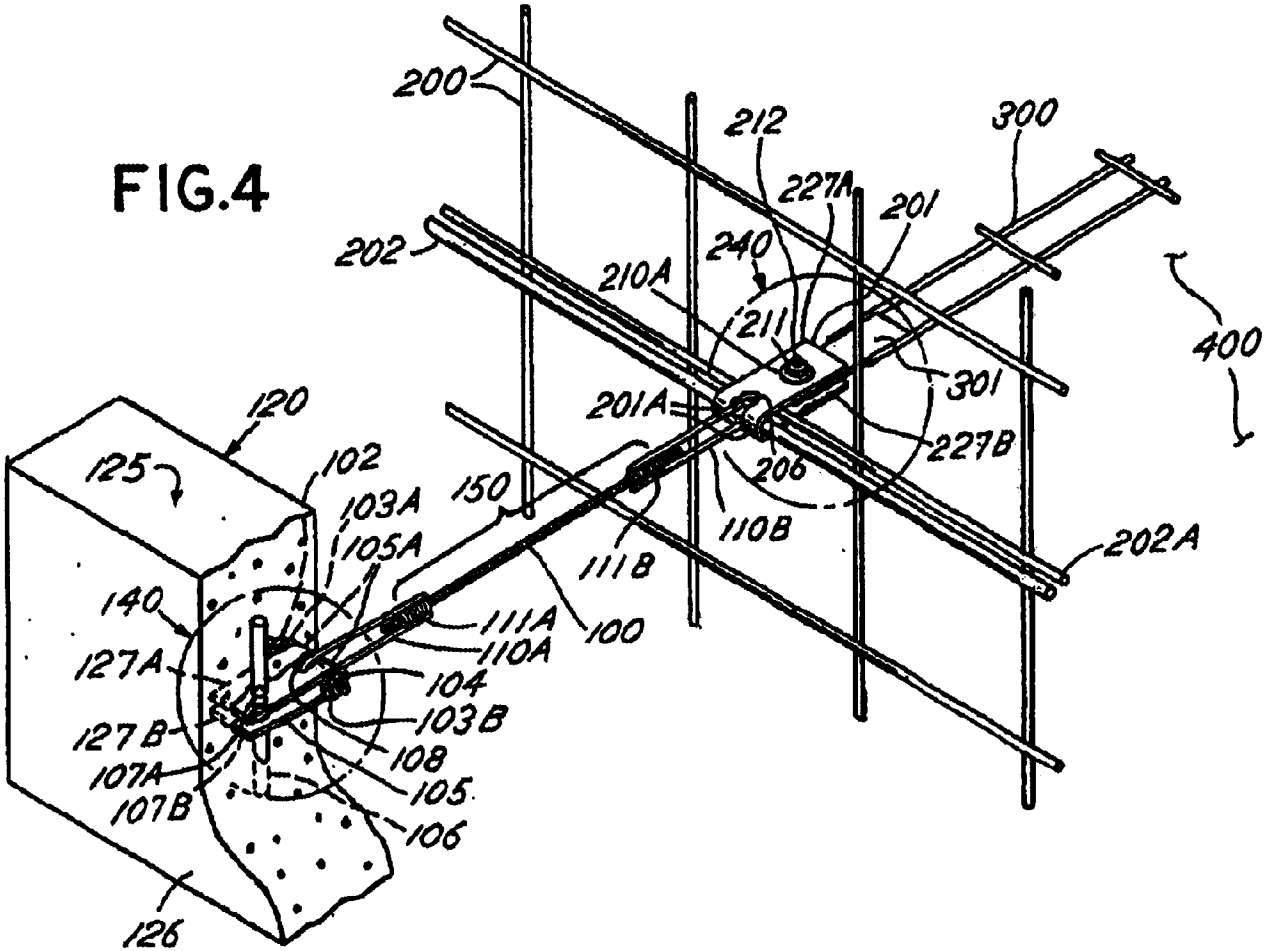
FIG. 4 is a perspective view of the completed alternative connector assembly incorporating the present invention with the connection at the panel face in a generally horizontal orientation.

FIG. 4 illustrates the configuration and appearance of the connector assembly in relation to the panel wall 125 and the wire facing units 200 of the mechanically stabilized earth mass. The configuration and appearance of the connector assembly in FIG. 4 differs from that presented in FIG. 3 only in that the orientation of the slotted clip 105 and anchor rod 106 in the precast concrete panel are rotated such that the bolt 102 is inserted horizontally through the apertures to affix the connection.

Figure 5:
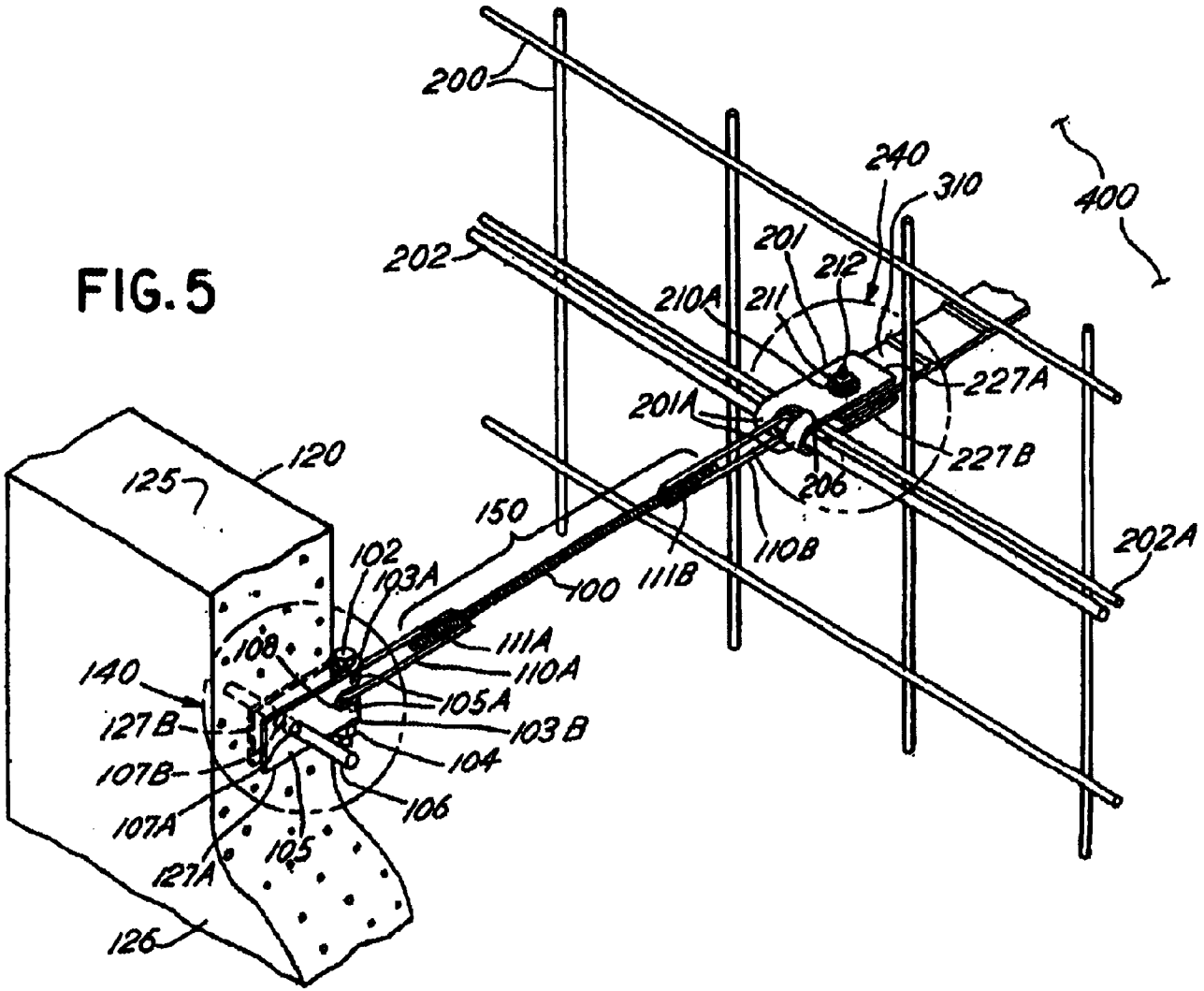
FIG. 5 is a perspective view of the completed connector assembly incorporating the present invention with strip-type tensile members in the mechanically stabilized earth mass, and a connection at the panel face in the vertical orientation.

FIG. 5 illustrates the configuration and appearance of the connector assembly in relation to the panel wall 125 and the wire facing units 200 of the mechanically stabilized earth mass. The configuration and appearance of the connector assembly in FIG. 5 differs from that presented in FIG. 3 in that the slotted clip 201 is connected to a tensile strip 310 by means of the bolted connection. As mentioned previously, various forms of tensile reinforcement are disclosed in the prior art, which are typically selected based on the backfill material. Note, however, that the tensile reinforcement may simply be selected based upon the availability of construction materials.

Figure 6:
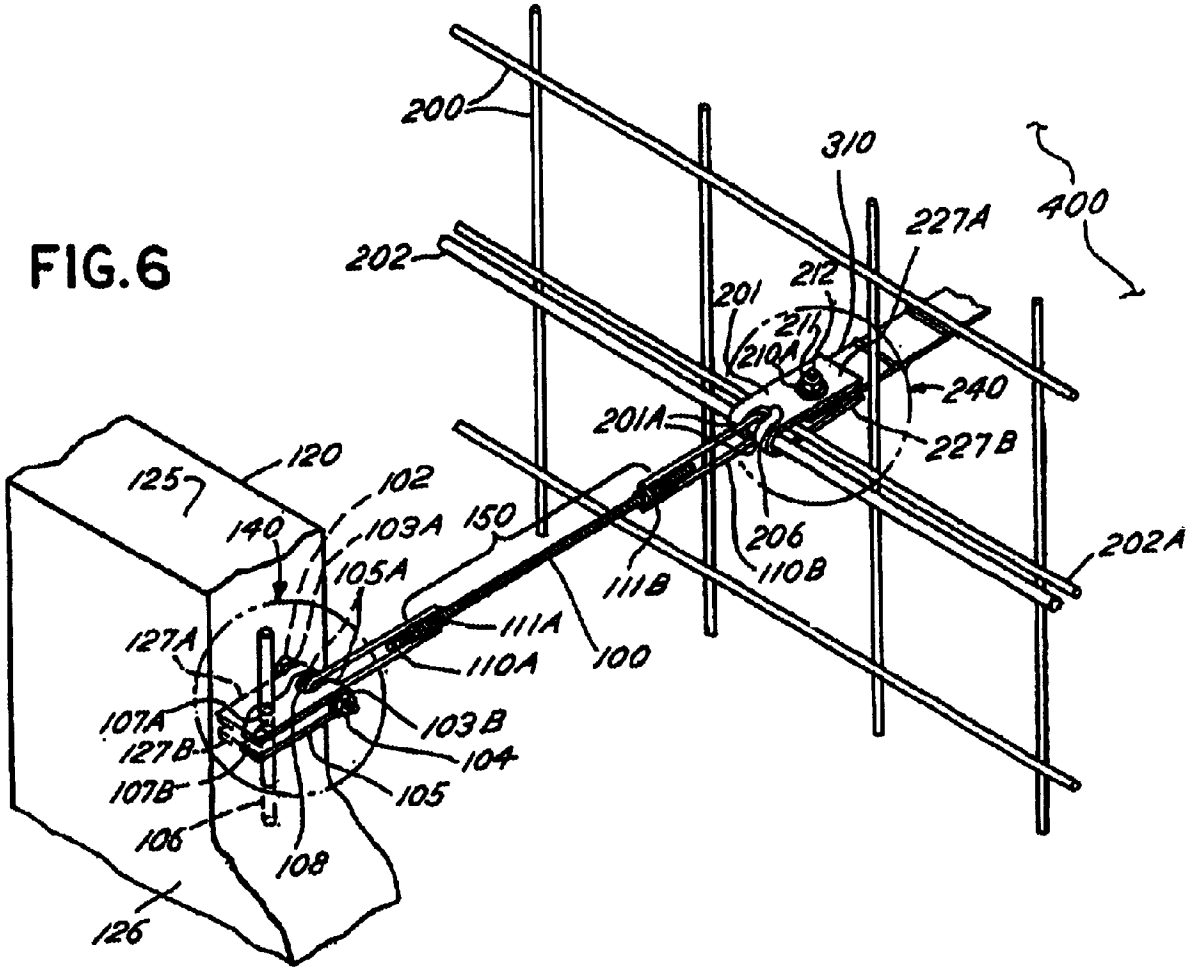
FIG. 6 is a perspective view of the completed connector assembly incorporating the present invention with the connection at the panel face in the horizontal orientation.

FIG. 6 illustrates the configuration and appearance of the connector assembly in relation to the panel wall 125 and the wire facing units 200 of the mechanically stabilized earth mass. The configuration and appearance of the connector assembly in FIG. 6 differs from that presented in FIG. 5 only in that the orientation of the slotted clip 105 and anchor rod 106 in the precast concrete panel are rotated such that the bolt 102 is inserted horizontally through the apertures to affix the connection.

FIG. 7 illustrates the universal joint mechanism 240 at the face of the wire mesh wall 200.

Thus, having described the foregoing invention, one skilled in the art would be enabled to practice the invention and know of the best mode for such practice contemplated by the inventor herein. Also one having such skill would readily understand many variations and changes that could be made in the above system without departing from the scope and content thereof.

We claim:

1. An apparatus for adjustably connecting a wire mesh facing of a mechanically stabilized earth mass to a concrete panel that forms a retaining wall facing, the apparatus comprising in combination:

(a) a connector comprising (i) a rod with a first end and a second end; (ii) a first connector assembly at the first end of the rod having a first aperture; and (iii) a second connector assembly at the second end of the rod having a second aperture;

(b) a first clip cast in the concrete panel and having a first notch for receiving said first connection assembly at a connection point that is generally fixed;

(c) a second clip attachable to a tensile member extending from a mechanically stabilized earth mass having a second notch for receiving the second connector assembly; and (d) first and second rod members positionable respectively through the first and second clips and simultaneously said first and second apertures to retain the first and second connection, said first and second notches sized to permit the first and second connection assemblies respectively to freely rotate.

2. The apparatus of claim 1, wherein the first and second connection assemblies each respectively further comprise a coil loop.

3. The apparatus of claim 2, wherein the rod is threadably attached respectively to the coil loop of the first and second connection assemblies.

4. A method for constructing a connector assembly according to claim 1 between a mechanically stabilized earth mass and a precast concrete panel wall comprising the steps of:

(a) attaching a slotted clip to an exposed end of a tensile members in a mechanically stabilized earth mass;

(b) connecting a first coil loop and a coil nut assembly to the slotted clip of part (a) by interlocking an aperture of the coil loop and an aperture of the slotted clip with a pin;

(c) connecting a second coil loop and a coil nut assembly to a slotted clip protruding from a back face of a precast concrete panel by interlocking an aperture of the coil loop and an aperture of the slotted clip with a pin;

(d) attaching a second end of a connector assembly rod to the second coil loop by threading the rod into the second coil nut attached to the coil loop;

(e) rotating a first end of the connector assembly rod to meet a first coil loop and coil nut assembly; and (f) threadably attaching the first end of the connector assembly rod to the first coil nut.

5. The method of claim 4 wherein the first end of the connector assembly rod is rotated to meet the first coil loop and coil nut assembly attached to the end of a tensile member that is in the closest proximity to the second end so that the horizontal and vertical offsets of the connector assembly is minimized.

6. An adjustable connector for attachment of spaced wall panels comprising, in combination:

(a) an elongate rod;

(b) a first universal joint mechanism attached to one end of the rod;

(c) a second universal joint mechanism attached to an opposite end of the rod;

(d) a first connection adjustment mechanism forming a first attachment connection between the first universal joint mechanism and the rod and capable of adjusting an attachment point;

(e) a second connection adjustment mechanism forming a second attachment connection between the second universal joint mechanism and the rod and capable of adjusting a second attachment point; and (f) a means for attaching the first and second universal joint mechanisms respectively to spaced wall panels at generally fixed connection points whereby the connector is adjustable to a minimal connection pathway between the spaced wall panels, wherein at least one of the first and second universal joint mechanisms comprise a slotted clip with a notch for receipt of the connection adjustment mechanism.

7. The apparatus of claim 6 wherein the first and second connection adjustment mechanisms are coil loop and coil nut assemblies.

8. A retaining wall comprising in combination: (a) a mechanically stabilized earth mass; (b) a precast concrete panel wall; and (c) the adjustable connector of claim 6.

9. An adjustable connector construction for attachment of spaced wall panels each panel having a connection point that is generally fixed; said construction comprising in combination:

(a) a turnbuckle assembly including an elongate rod having threads at the opposite ends thereof;

(b) a first turnbuckle bracket threaded on the elongate rod at the one end, the turnbuckle bracket including an elongate loop longitudinally extending from the first end;

(c) a first linkage;

(d) a first pin, joining the first turnbuckle bracket loop at the one end by extending through the loop and the first linkage, said first linkage fixably attachable to a wall panel;

(e) a second turnbuckle bracket threaded to the opposite end of the rod, the second turnbuckle bracket including an elongate loop longitudinally extending from the opposite end;

(f) a second linkage; and (g) a second pin, joining the second turnbuckle bracket loop at the opposite end to the second linkage by extending through the loop and the second linkage, said second linkage fixedly attachable to a wire mesh facing of a mechanically stabilized earth mass, said first linkage and said second linkage being orientated with respect to each other to provide three degrees of freedom of movement of the elongate rod, and said rod being extensible to alter the longitudinal spacing of said turnbuckle brackets, at least one of said first and second linkage comprising a slotted clip with a notch for receipt of a turnbuckle bracket loop and a pin fitted simultaneously through said clip and turnbuckle bracket loop.

10. The apparatus of claim 9 wherein the first and the second turnbuckle bracket is a coil loop and coil nut.

11. A retaining wall comprising in combination: (a) a mechanically stabilized earth mass; (b) a precast concrete panel wall; and (c) the adjustable connector of claim 9.

12. An adjustable connector construction for connection of spaced wall members at generally fixed connection points, said connection comprising, in combination:

(a) an elongate threaded rod member having a first and a second end;

(b) a first bracket including a threaded bracket socket and a longitudinal loop extending from the socket, the first bracket socket threadably attached to the first end of the rod with the loop extending longitudinally from the first end;

(c) a first linkage member comprising a first clip having an end notch for receiving the loop of the first bracket;

(d) a first pin extending through the first linkage member thereby connecting the loop of the first bracket to form a universal joint connection;

(e) a second bracket including a threaded socket and a longitudinal loop extending from the socket, the second bracket socket threadably attached to the second end of the rod with the loop extending longitudinally from the second end;

(f) a second linkage member comprising a second clip having an end notch for receipt of the loop of the second bracket;

(g) a second pin extending through the second linkage member connecting the loop of the second bracket to form a universal joint connection, whereby each linkage is attachable to fixed points of a separate spaced wall member and the connector is adjustable to provide a straight line connection therebetween.

13. The apparatus of claim 12 wherein the first and the second bracket is a coil loop and coil nut.

14. A retaining wall comprising in combination: (a) a mechanically stabilized earth mass; (b) a precast concrete panel wall; and (c) the adjustable connector of claim 12.

15. An array of connector assemblies comprised of a plurality of connectors where the ends are pivotally connected at fixed spaced pivot points to accommodate misalignment of the connection points, said connectors forming angled rather than straight connections which in combination define a three-dimensional space truss that resists wall movement horizontally, vertically, as well as inward or outward from the face of the mechanically stabilized earth mass, where the ends of each connector define a first array at the wire mesh panels, said arrays not being congruent, said connectors including at least one slotted clip with a notch connected to a loop positioned in said notch and retained by a pin fitted simultaneously through the clip and loop.

* * * * *